US008844159B2

(12) United States Patent
Guyomarc'h

(10) Patent No.: US 8,844,159 B2
(45) Date of Patent: Sep. 30, 2014

(54) SYSTEM AND METHOD FOR DRYING WOOD

(75) Inventor: Raymond Guyomarc'h, Saint Theodorit (FR)

(73) Assignee: HOLCOP, Boulogne Billancourt (FR)

( * ) Notice: Subject to any disclaimer, the term of this patent is extended or adjusted under 35 U.S.C. 154(b) by 1815 days.

(21) Appl. No.: 12/160,578

(22) PCT Filed: Jan. 10, 2007

(86) PCT No.: PCT/FR2007/000041

§ 371 (c)(1),
(2), (4) Date: Aug. 17, 2010

(87) PCT Pub. No.: WO2007/080318

PCT Pub. Date: Jul. 19, 2007

(65) Prior Publication Data

US 2010/0299955 A1 Dec. 2, 2010

(30) Foreign Application Priority Data

Jan. 10, 2006 (FR) ..... 06 00212

(51) Int. Cl.

| | |
|---|---|
| ***F26B 3/04*** | (2006.01) |
| ***F26B 21/14*** | (2006.01) |
| ***F26B 3/18*** | (2006.01) |
| ***F26B 15/16*** | (2006.01) |
| ***F26B 21/08*** | (2006.01) |
| ***F26B 23/02*** | (2006.01) |

(52) U.S. Cl.

CPC . *F26B 21/14* (2013.01); *F26B 3/18* (2013.01); *F26B 15/16* (2013.01); *F26B 21/086* (2013.01); *F26B 23/028* (2013.01); *F26B 2210/16* (2013.01)

USPC ..... 34/407; 34/427; 34/443; 34/468

(58) Field of Classification Search

CPC ... F26B 3/00; F26B 2200/24; F26B 2210/164
USPC ..... 34/406, 407, 427, 443, 467, 468, 480
See application file for complete search history.

(56) References Cited

U.S. PATENT DOCUMENTS 1,684,627 A 9/1928 Hope et al.
3,986,268 A * 10/1976 Koppelman ..... 34/257

(Continued)

FOREIGN PATENT DOCUMENTS

DE 2161390 A1 6/1973
DE 2828247 A1 1/1980

(Continued)

OTHER PUBLICATIONS

English translation of FR 2854831.*

*Primary Examiner* — Jiping Lu
(74) *Attorney, Agent, or Firm* — Greer, Burns & Crain, Ltd.

(57) ABSTRACT

A system for drying a load of wood including: a heat generating device providing heat necessary for drying the load of wood, apparatus for generating a gaseous coolant flow for treating the load of wood by combustion of biomass under $O_2$, the gaseous coolant flow being essentially constituted by $CO_2$, a heat exchange device allowing the transfer of the heat produced by the heat generating device to the gaseous coolant flow for treating the load of wood, a unit for treating/drying the load of wood, including a central volume, known as a technical or treatment volume, dedicated to the drying of the wood, and inlet and outlet hatches for the loads of wood, situated at the upstream and downstream ends of said central volume, and a thermal device for the dehydration and condensation of the steam extracted from the wood during the drying cycle.

3 Claims, 8 Drawing Sheets

(56) References Cited

U.S. PATENT DOCUMENTS

| | | | | |
|---|---|---|---|---|
| 4,014,107 | A | 3/1977 | Bachrich | |
| 4,431,405 | A * | 2/1984 | Eatherton | 432/72 |
| 5,752,328 | A * | 5/1998 | Yamamoto | 34/418 |
| 2002/0108266 | A1 | 8/2002 | Nagel et al. | |
| 2008/0277027 | A1 * | 11/2008 | Bernon et al. | 144/364 |

FOREIGN PATENT DOCUMENTS

| | | | |
|---|---|---|---|
| DE | 199 51 627 | A1 | 7/2000 |
| DE | 100 06 036 | A1 | 8/2000 |
| DE | 103 45 968 | A1 | 4/2005 |
| EP | 0 651 219 | A1 | 5/1995 |
| EP | 1 132 701 | A2 | 9/2001 |
| FR | 2 632 714 | | 12/1989 |
| FR | 2 660 424 | A1 | 10/1991 |
| FR | 2 673 174 | A1 | 8/1992 |
| FR | 2 786 424 | A1 | 6/2000 |
| FR | 2 854 831 | A1 | 11/2004 |
| GB | 665460 | | 1/1952 |
| WO | WO 93/21489 | A1 | 10/1993 |
| WO | WO 02/25192 | A1 | 3/2002 |
| WO | WO 2005116551 | A1 * | 12/2005 |

* cited by examiner

SYSTEM AND METHOD FOR DRYING WOOD

THE FIELD OF THE INVENTION

The present invention relates to a system for drying a load of wood, in particular timber. It also relates to a method for drying wood utilized in the system according to the invention.

BACKGROUND

The drying of the timber is an obligatory stage for transforming the raw material obtained from sawmills into marketable products. A European directive (which comes into force on 25 Jun. 2005) requires the drying of the timber before its transport, with the objective of avoiding the unnecessary, expensive and polluting transport of the mass of water contained in the raw material.

The drying of the timber is defined by operating regulations which correspond to satisfactory behaviour requirements of the product at the end of the treatment: too rapid drying or at too high a temperature causes lesions (splits, deformations etc.) in the timber, making it unsuitable for the intended use.

The volume of the dryers dedicated to this use ranges from 20 to several hundred cubic meters. The drying of the wood is carried out by the combined action of intense ventilation and heat (circulation of hot air). Each dryer is therefore equipped with its heat system and one or more fans.

Several methods make it possible to dry the wood:

natural drying (in the open air) the timber is stored in a zone (covered or not covered) for several months, or even years. When the desired moisture content is reached the wood is utilized.

Artificial drying which comprises two methodologies:

drying at atmospheric pressure or slightly above, drying under vacuum.

In drying at atmospheric pressure or slightly above, the overpressure is obtained by the circulation of a large volume of air heated by a heat generating system (electric resistance heaters, heat pumps, boilers burning wood or other solid fuels, boilers and burners fired by gas or other liquid fossil fuels etc.) The circulation of the volume of hot air through the load of wood to be treated allows the evaporation of the water contained in the wood. The air saturated with this steam is discharged into the atmosphere, in continuously renewable cycles.

The new replacement air comes from the ambient atmosphere and contains a greater or lesser portion of moisture which impairs the yield of the method, the air charged with moisture being more rapidly saturated with steam. The volume of treatment air therefore has to be increased, drying the air improves this yield, but this method is expensive.

The quantity of heat, which is used for the drying, is proportional to the quantity of water to be evaporated (latent heat of evaporation) irrespective of the drying system. When the water, which is extracted from the wood, is condensed after treatment (certain systems do this), the latent heat is rarely exploited, as it is difficult to recover by most of the systems except, perhaps, by heat pumps.

In drying under vacuum, the systems have a reduced treatment capacity, as the pump-down of large volumes is difficult and very expensive. By reducing the environmental pressure of the load of wood to be dried, the evaporation temperature is reduced. Continuous aspiration avoids the internal back pressures in the wood, linked to the evaporation of the water, which allows a better transfer of the water retained internally towards the outside of the wood in order to be evaporated there, and thus more rapid drying. The low pressures created in these systems (pump-down) increase the volume of the steam extracted, in proportion to the degree of negative pressure which must be compensated for by the extraction capacity. The latent heat, provided for the evaporation of the water, is difficult to recycle.

These systems are very significant consumers of heat and electrical energy, which makes their viability problematical. In order to be profitable, these systems must be integrated into programmes with high added value, or receive financial assistance.

The cumulative effect of these factors is that the drying of timber is difficult for professional sectors operating under already highly-adapted economic conditions.

SUMMARY OF THE INVENTION

An objective of the invention is to remedy the above-mentioned drawbacks.

Another objective of the invention is to propose a more economical and more environmentally friendly wood drying system.

The invention thus proposes a system for drying a load of wood comprising:

heat generating means providing the heat necessary for the load of wood, heat exchanging means allowing the transfer of the heat produced by the heat generating means, to a gaseous coolant flow for treating the load of wood, a unit for treating the load of wood comprising a central volume, known as a technical or treatment volume, which is the part dedicated to drying the wood, and inlet and outlet hatches for the loads of wood, situated at the upstream and downstream ends of said central volume, and thermal means for the dehydration or condensation of the steam extracted from the wood during the drying cycle.

The drying system according to the invention is energy-saving and environmentally friendly. On the one hand, the latent heat of evaporation is recovered at the best point in time in the coolant cycle to be reused in the drying cycle. The internal configuration of the technical zones is produced depending on the dimensions of the loads of wood in common use. These technical zones are therefore adjusted to the dimensions of the load of wood in order to use only the gaseous volumes necessary for treating said load. On the other hand, the treatment coolant gas is carbon dioxide $CO_2$. This gas is produced by the combustion of vegetable biomass under industrial $O_2$, in the heat generator associated with the drying system.

In an advantageous version, the system according to the invention can comprise means for generating the coolant gaseous flow. This gaseous flow can for example comprise $CO_2$.

Moreover, the system can advantageously comprise means for continuously recycling the gaseous flow for treatment of the load of wood. In this way all or part of the gaseous flow can be reused in the system, for example, in a drying cycle of a load of wood. The recycled gaseous flow can also be used in any other system for carrying out operations independent of the drying of a load of wood. Finally, it can also be stored.

The treatment unit is for example a parallelepiped comprising three basic volumes: the central volume, the inlet hatch and the outlet hatch.

The central volume, known as a technical or treatment volume, is the part dedicated to drying the wood.

According to a feature of the invention the central volume of the treatment unit can be divided into substantially identical drying bays, which form tunnels in which the load of wood to be treated follows a continuous cycle.

Moreover each treatment bay/tunnel is autonomous and can be programmed individually. For example each treatment bay/tunnel can be divided into substantially identical drying zones, in which the load of wood to be treated undergoes a part of the cycle programmed for the treatment bay/tunnel.

The load of wood to be dried can in particular be transported in the tunnels on carriage means. These carriage means can for example be provided with temperature and humidity probes which allow continuous monitoring of the load of wood during the drying cycle. Similarly, each bay can be equipped with sensors of the position of the carriages carrying the loads of wood to be treated. This allows a better monitoring of the state of the load of wood to be dried.

According to an advantageous feature, the side walls of the bays/tunnels of the central volume can be composed of a metal double partition which configures a technical space in which the gaseous flow for treating the load of wood is channelled. Moreover, the internal partition of the side walls of the treatment volume can comprise vertical louvres throughout its height. These louvres, which are situated on the internal surface of the side walls of the treatment volume, allow in particular the diffusion of the gaseous treatment flow over said load of wood or the extraction of the gaseous mixture after treatment.

In a particular version of the system according to the invention, the external partition of the side walls of the treatment volume is complete. This external partition of the side walls of the treatment volume can be arranged in order to carry out either the closing of the treatment volume on the outside, said external partition being insulated by thermal shielding, or the separation of two parallel bays/tunnels and separation of the two corresponding technical spaces in which the treatment gases are conveyed.

Advantageously, the technical space of the walls in which the gaseous treatment flow is conveyed can be separated in the longitudinal direction of the bay/tunnel by internal vertical partitions which delimit the so-called treatment zones known as stage/zones or technical/zones.

According to a feature of the invention, the ceiling of the bays/tunnels can also be made up of two superimposed metal sheets forming a technical space which can be separated by vertical partitions, in order to delimit the treatment zones. Moreover, the overhead technical space can be covered by a thermally insulated roof.

Advantageously, each bay/tunnel can comprise a system for the distribution of the gaseous flow for treating the load of wood and extraction of the gaseous mixture after treatment. Such a system can be arranged in the technical space located in the ceiling of the bays. In an advantageous version this system can comprise:

- a flow reversal caisson,
- a duct connecting the technical space of the left-hand wall to the flow reversal caisson,
- a duct connecting the technical space of the right-hand wall to the flow reversal caisson,
- a duct connecting the flow reversal caisson to the gaseous treatment flow supply line and
- a duct connecting the flow reversal caisson to the used gas extraction line.

The flow reversal caisson makes it possible to alternate the direction of flow of the coolant gas, and of the extracted gas, from the right-hand partition towards the left-hand partition and vice versa, alternatively as programmed The inlet and outlet hatches of the loads of wood are two volumes which can be identical. They are situated at the upstream and downstream ends of the central volume.

Advantageously, the inlet and outlet hatches comprise means allowing the lateral movement of the carriages.

The inlet hatch is a volume into which the loads of wood ready to be dried are introduced. These loads can be stored in this hatch while waiting to be introduced into the treatment volume. This introduction can be managed by the programme for carrying out the drying system.

The outlet hatch is a volume into which the dried loads of wood are introduced. These loads can be stored in this hatch while awaiting their use which may be conversion of the wood on the drying site, removal for transport to a distant conversion site, or storage in a logging depot.

The heat generating means mainly provide the heat necessary for the method. They can comprise means of combustion of solid fuel. These means can comprise a heat generator.

In an advantageous version, the solid fuel is unpolluted vegetable biomass.

Moreover, the combustion of the solid fuel can be carried out under $O_2$ in order to produce the $CO_2$ used by the system in the drying of a load of wood.

In an advantageous version of the invention, the solid fuel is preferably a densified form of vegetable biomass, and more particularly of [Bio-D]® for its better energy yield and its ratio of $CO_2$ produced. The solid fuel can also be torrefied vegetable biomass. In this case, the roasting relates to offcuts or cuttings of wood with dimensions which must correspond to the correct characteristics in order to produce heat and $CO_2$ with an optimum yield. All other sources, types and presentations of vegetable biomass can be involved in the production of the energy/$CO_2$ necessary for the method. The conditioning of the materials used can simply be adapted to the supply and configuration of the heat generator which is installed.

In a particular version of the invention, the heat exchange means can comprise a heat exchanger. The transfer of the heat produced by the heat generator, by the coolant gas used for the treatment of the wood, is carried out in a heat exchanger.

The thermal dehydration or condensation means can comprise a dehydration heat exchanger or a condenser of the steam extracted from the wood during the drying cycle.

Advantageously, the thermal dehydration or condensation means can be installed on a duct connecting a flow reversal caisson to a used gas extraction line.

The thermal dehydration or condensation means can comprise liquid $CO_2$ diffusers, making it possible to diffuse liquid $CO_2$ into the gaseous flow.

This liquid $CO_2$ diffusion can serve to condense steam within the gaseous flow.

The drying system according to the invention can moreover comprise a fan/extractor for collecting the gaseous flow after treatment. This fan/extractor can in particular be installed in the low temperature gaseous flow after treatment downstream of the stage of condensation/cooling of said flow.

In a particular version of the invention, the system can also comprise means for mixing the gaseous flow, at the outlet from the condensation or dehydration means, with the gaseous treatment flow.

It can also comprise means for distributing the low-pressure steam originating from the heat generator so as to regulate the drying stress, over the load of wood to be dried.

The system according to the invention can comprise means for condensing part of the $CO_2$ produced. In this way, the surplus $CO_2$ is recovered and stored. This surplus $CO_2$ can then be used in a safety system or can be sold.

In an advantageous version of the invention, the system according to the invention can comprise water injection means which are arranged in each bay. These means of injection can serve, by injection of steam into the bays, as a safety circuit or means of acting on a drying cycle of a load of wood.

Finally, the drying system according to the invention can advantageously comprise means of communication between the different components of said system. These means of communication can be of wired or "wireless" type.

According to another aspect of the invention a bio-thermal method for drying a load of wood is presented, implemented in the system according to the invention, comprising:

generation of heat from heat generating means, a heat exchange allowing the transfer of the heat produced by the heat generating means, to a coolant gaseous flow for treatment of the load of wood, and a stage of drying the wood comprising:

a stage where said load of wood is introduced into a wood treatment volume, a sequence for drying said load of wood in said treatment volume, a stage where said dried load of wood is removed from the treatment volume.

In an advantageous version of the invention, the method comprises recovery or recycling of the gaseous treatment flow after treatment of the load of wood. This recycling can in particular consist of the reuse of the gaseous flow in a stage of the method.

The generation of heat is carried out, in particular, by recovery of the heat of a gas obtained by combustion at the outlet from the heat generating means.

Advantageously, the coolant gas is a neutral gas, for example $CO_2$. In a particular version of the invention, the heat can be obtained by combustion of biomass, vegetable for example. This combustion can be carried out under $O_2$. Such a combustion produces a large quantity of $CO_2$. This gas is collected at the outlet from the heat generator, after its heat of combustion has been transferred to the coolant gas in the heat exchanger of the same generator.

The compatibility of the $CO_2$ with the phytobiology of the wood depends on the chemistry of the wood which comprises (on average) 50% carbon and 40% oxygen. Moreover, the $CO_2$ solvent is water, therefore the internal humidity of the wood has a tendency to absorb, or even suck in the $CO_2$, thus optimizing the transfer and distribution of the heat which it conveys.

The method according to the invention comprises in a particular version a recovery of the heat from the gas generated by combustion which can be subsequently reused in the vaporization of the liquid $O_2$. For example, The $CO_2$ is at a low temperature at its collection point. The reduction in temperature can be enhanced in a secondary exchanger where the residual heat can serve for the evaporation of the liquid oxygen which can be used for the combustion of the biomass.

Moreover, the method according to the invention can also comprise a treatment of the drying gaseous flow for filtering out the unburnt carbon before its capture. In fact, if necessary, the $CO_2$ at low temperature can be filtered in order to trap the unburnt carbon particles which could remain in the gas.

The $CO_2$ can then be transferred into the heat exchanger of the generator where it acquires the heat and temperature capacities necessary for the evaporation of the water contained in the wood to be dried. The hot $CO_2$ is then transferred towards the distribution systems which manage the introduction of the coolant gas into the technical volume for treatment of the wood.

After its passage into the technical zone for treatment of the wood, the volume of $CO_2$ is increased by the volume of the water extracted from the wood and evaporated. This gaseous mixture is advantageously sucked in by an electrical ventilation system which transfers the mixture towards a steam condensation unit. The condensed water is recovered, by gravity, in liquid phase, and can be reintroduced, without any other form of processing, into the natural environment as it contains no pollutant, since it has been distilled.

Advantageously, the gaseous flow for treating the load of wood is completed by the gas obtained at the outlet of the heat generating means. In fact, during its transit through the condensation unit, the water extracted from the wood is essentially removed from the gaseous mixture. The temperature of the $CO_2$ is considerably reduced at the same time (below 10° C.) it then recovers all its coolant gas qualities for a new wood drying cycle. Thus, the gaseous flow for treating the load of wood is advantageously in a closed circuit where it is continuously recycled.

Advantageously, the recycling of the gaseous treatment flow can comprise a dehydration and/or condensation phase. Condensation of the steam can be obtained by an injection of liquid $CO_2$ which is sprayed into the gaseous volume extracted from the treatment zone. The latent heat, originating from the condensation of the steam, allows the evaporation of the $CO_2$ in this same exchanger/condenser. This heat capacity is, at the same time, recovered by the $CO_2$, which remains gaseous at the steam condensation pressures/temperatures.

In a particular version, part of the gas generated by combustion is compressed and stored. This tank of gas can be used for the safety of the system. The gas, $CO_2$, under a coolant volume to which is added the volume which has been used for the condensation of the steam, can then be recycled by the thermal system of the unit in order to be reused in the wood treatment cycle. The method according to the invention thus describes a permanent loop of $CO_2$ valorization and heat exploitation. In these cycles, the only thermal energy consumed is in general the sensible heat which allows the raising of the temperature of the load of wood to be treated.

Advantageously the technical zone of the treatment volume is under constant negative pressure. This negative pressure thus makes it possible to promote the transfers of the internal moisture of the wood towards the surface.

The absence of pressure at the surface of the wood means that any internal evaporation of the moisture is transferred to the outside, on the one hand, without having to undergo the surface back-pressures which cause critical losses of loads, which slow down the evacuation of the steam and create localized overheating which is harmful to the wood, and on the other hand without subjecting the wood to a any localized overpressure or harmful overall internal pressure.

The slow and continuous internal evaporation regulates the heat transfers towards the wood and is capable of absorbing and diluting all the excesses of heat which would be likely to subject the wood to harmful heat stresses.

The negative pressure guarantees the fluidity of the flow of the coolant gas in the treatment volume, it eliminates any risk of concentration in the enclosure of steam which could condense on the walls.

Other advantages and characteristics will become apparent on examination of the detailed description of an embodiment which is in no way limitative, and the attached drawings in which:

DETAILED DESCRIPTION

Figure 2:
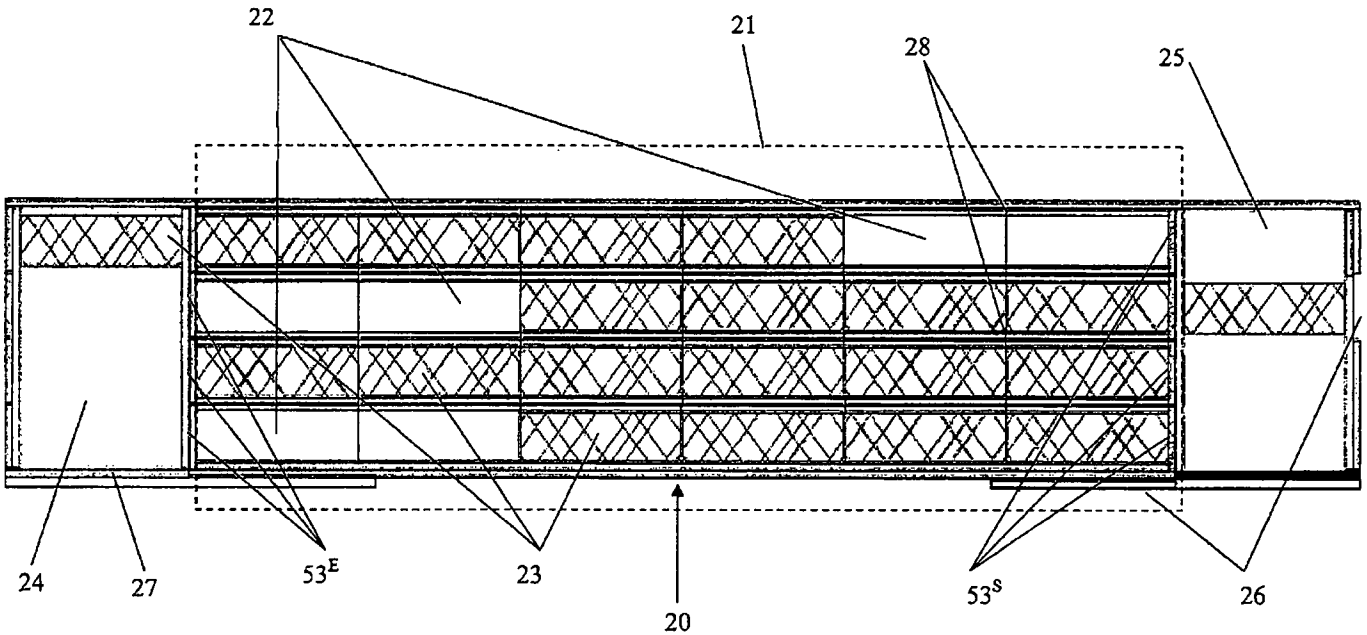
FIG. 2 shows a diagram of an example of a wood drying treatment unit according to the invention.

A description will now be given, with reference to FIG. 2, of an embodiment example of a drying system according to the invention, at the same time as the method implemented in this system. This system comprises a treatment unit 20 the central volume of which 21 is divided into identical drying bays 22, which form tunnels in which the wood to be treated 23 follows a continuous cycle. This cycle is "sequenced" in stages which constitute the "technical zones" for drying, during which the wood 23 undergoes one of the phases of the programmed drying. This method makes it possible to carry out a specific programming for each bay 22, and for each stage/technical zone of this bay 22. Thus each treatment bay/tunnel 22 is divided into substantially identical drying zones, in which the load of wood 23 to be treated undergoes a part of the programmed cycle for the treatment bay/tunnel 22. The connection system and the computerized control program allow this flexibility. It is thus possible to react to the different programmings, during treatment, in order to refine and optimize the drying of said stage/technical zone before passing to the next.

Whilst the central treatment volume 21 may be constituted by only a single bay/tunnel 22, it can also contain as many as the end user requires or allows (and the feasibility on the installation site) The bays 22 are arranged parallel to each other. Each bay 22 constitutes a tunnel of identical cross-section and length (the length is defined by the end user). The dimensions of these bays/tunnels 22 can be determined by those relating to the road transport of wood: for example 2.20 m wide, 12/13 m long and 2.20 m high.

The internal dimensions of each bay 22 of the dryer are therefore established as a function of these parameters: width, height and length, plus the safety and operating margins on either side. In order for the treatment of the wood 23 to be homogeneous, the internal section of the bays/tunnels 22 has been defined at a width, for example of 1.45 m and a height of 2.25 m, the length being determined by the interest of the end user.

A module length has been defined for producing standard loads suitable for use.

Figure 3:
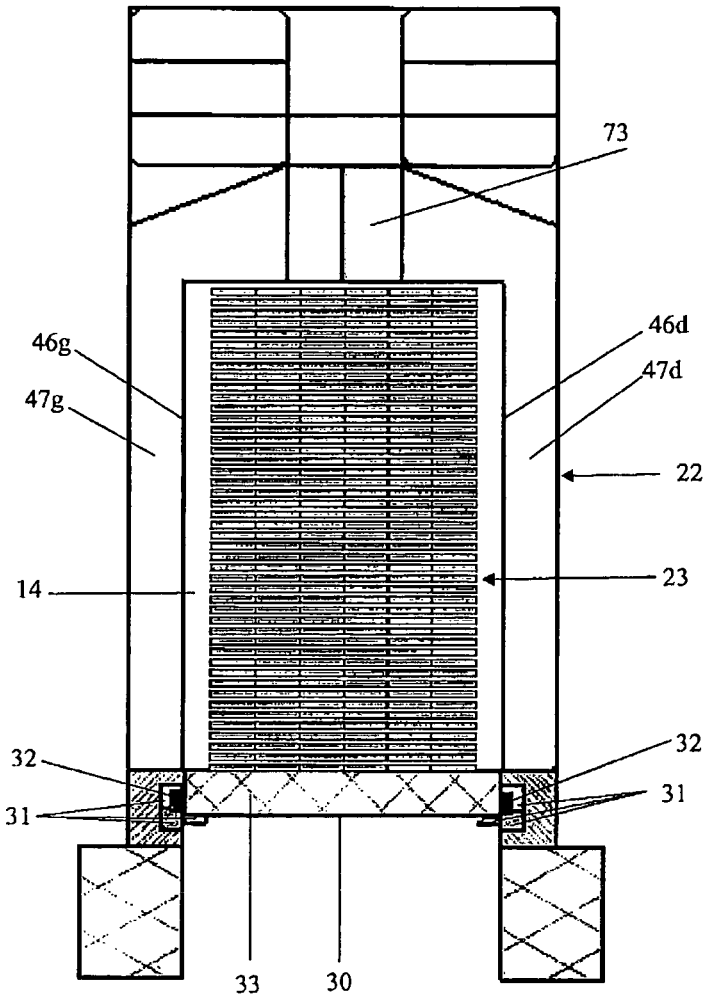
FIG. 3 shows a cross-section of an example of a drying bay.

A mobile carriage 30 as represented in FIG. 3, carrying the load of wood 23 to be treated should be:

- suitable for the width of the bay/tunnel 22: 1.45 m in this example,
- of a length corresponding to timber standards: 6.50 meters in length. The most common, large standard timber lengths, are between 6 meters and 6.40 meters (the length of the loads on the transport lorries is 12/13 meters).

This organization of the system makes it possible to dimension the length of the treatment bays/tunnels 22 of a module of a load to be treated with as many multiples of said module/load as required in the interests of the end user. The base (floor) of the bays/tunnels 22 is thus constituted by the carriages 30 carrying the loads of wood to be treated 23. Thus, each carriage 30 corresponds to one drying zone.

Each treatment bay/tunnel 22 is autonomous. These bays/tunnels form part of the overall treatment volume 21 but can be programmed individually, depending on the characteristics of the wood to be dried and of the desired final parameters. This allows an integral automation of the whole of the central treatment volume 21, with no possibility of interaction between one bay/tunnel 22 and another. These characteristics allow the complete optimization of the control of the method, for an energy consumption closest to the real need (for the evaporation of the programmed quantity of water).

This configuration makes it possible to simultaneously treat different types of wood or different thicknesses in each bay/tunnel 22 and to program different temperatures and drying times for each bay 22.

The central volume 21 dedicated to the drying, in this example, is permanently under $CO_2$. This gas is totally neutral as regards the chemical/physical phytobiology of the wood, and it neutralizes all the risks linked to the safety of the load to be treated as it is the final carbon combustion phase, therefore completely non-flammable. For user safety, the central volume 21 must be totally automated in order to prevent any possible entry by operating staff, of the central volume 21 when it is under $CO_2$.

Figure 4:
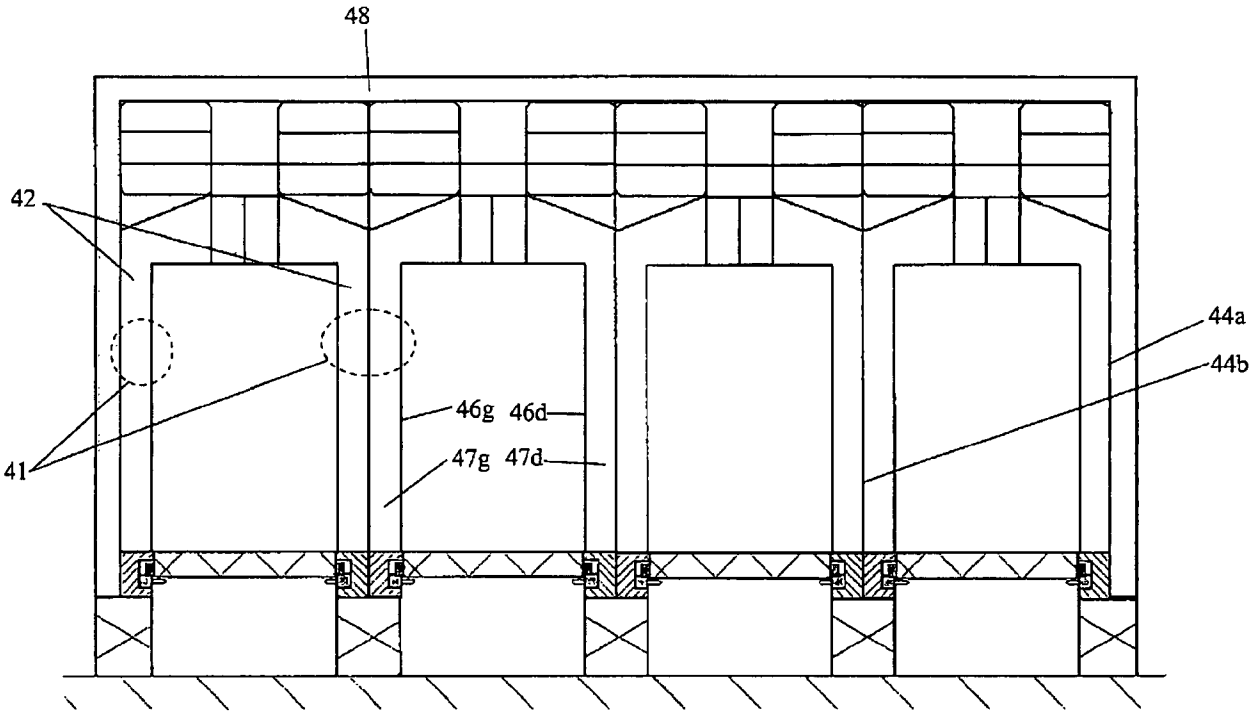
FIG. 4 shows a cross-section of an example of a drying unit with four bays.

In FIG. 4, the side walls 41 are composed of a metal double partition which configures a technical space 42 in which the treatment gases is conveyed. The direction of circulation of the coolant gas, for the drying of the wood, is regularly alternated for perfect homogeneity of the treatment. Therefore, each wall 46*d* and 46*g* is both that through which the coolant gas is introduced and also that through which said coolant gas and the steam are extracted.

Figure 7A:
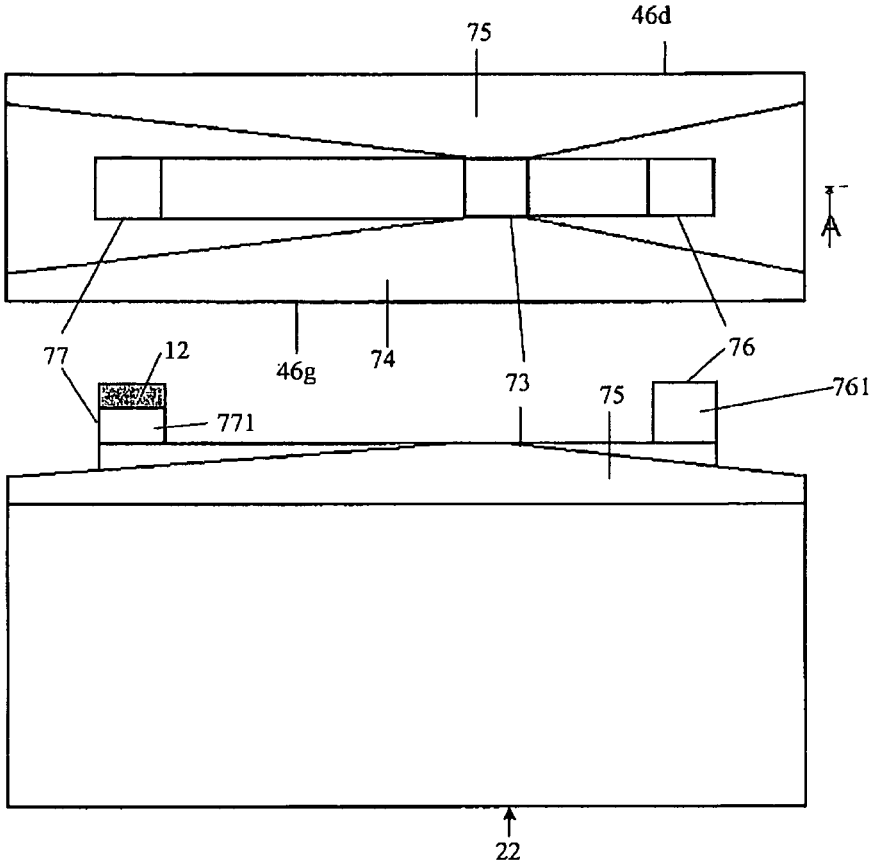
FIGS. 7*a* and 7*b* show an example of a coolant gas distribution system in a bay/tunnel, with a top view, a side view and a cross-section view.
Figure 7B:
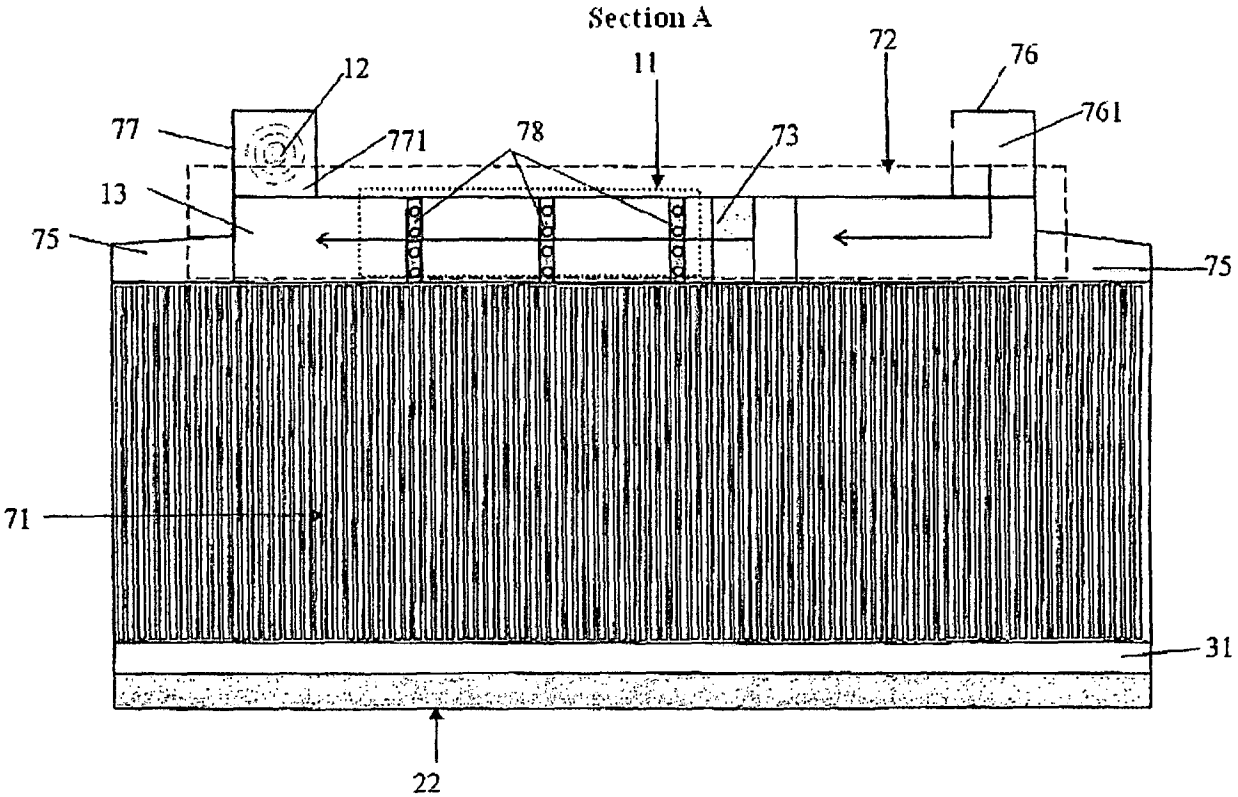

The internal surface of said walls 46*d* and 46*g*, relative to the treatment volume (partition on the side of the load of wood), comprises vertical openings (louvres) which can be seen in FIG. 7*b*. These louvres allow the diffusion of the coolant $CO_2$ over the load of wood 23 or the extraction of the gaseous mixture after treatment ($CO_2$+steam) for recycling.

The external partition 44*a*, 44*b* of the wall is complete (external surface of the technical space in which the treatment gas ($CO_2$ or $CO_2$+steam) is conveyed. This external partition of the side walls of the treatment volume is arranged in order to achieve either the closing of the treatment volume to the outside, in which case this external partition 44*a* is insulated by thermal shielding, or the separation 44*b* of two parallel bays/tunnels 22 and separation of the two corresponding technical spaces 42 in which the treatment gases are conveyed.

The technical space of the walls 42, in which the treatment gas (coolant $CO_2$ or $CO_2$+steam) is conveyed, is separated in the longitudinal direction from the bay/tunnel 22 by internal vertical partitions 28 which delimit the treatment zones (so-called stage zone or technical zone).

As shown by FIGS. 7*a* and 7*b*, the ceiling of the bays/tunnels 22 also comprises two superimposed metal sheets, forming the technical space 72 in which the system for distribution of the coolant $CO_2$ and extraction of the gaseous mixture after treatment is arranged. This space is separated like the vertical partitions, in order to delimit the treatment zones.

Each technical treatment zone therefore corresponds to a module/load of timber to be dried and comprises a distribution/extraction system which comprises:

- a flow reversal caisson 73: this makes it possible to alternate the treatment flow from the right-hand wall 46*d* to the left-hand wall 46*g*, in order to homogenize the drying of the load of wood 23. The flow reversal caisson 73 makes it possible to alternate the flow direction of the coolant gas, and of the extracted gas, from the right-hand partition 46*d* towards the left-hand partition 46*g* and vice versa, alternatively according to the programming,
- a duct 74 connecting the technical space 47*g* of the left-hand wall 46*g* to the flow reversal caisson,
- a duct 75 connecting the technical space 47*d* of the right-hand wall 46*d* to the flow reversal caisson,
- a duct 76 connecting the flow reversal caisson to the coolant, hot and dehydrated $CO_2$ supply line 761,
- a duct 77 connecting the flow reversal caisson to the extraction duct 771 of the gas used ($CO_2$, more the steam extracted from the wood). The dehydration/condensation heat exchanger 11 is installed on this duct, which will make it possible to condense the steam extracted from the wood, and the extraction fan 12, as represented in FIG. 1.

Figure 1:
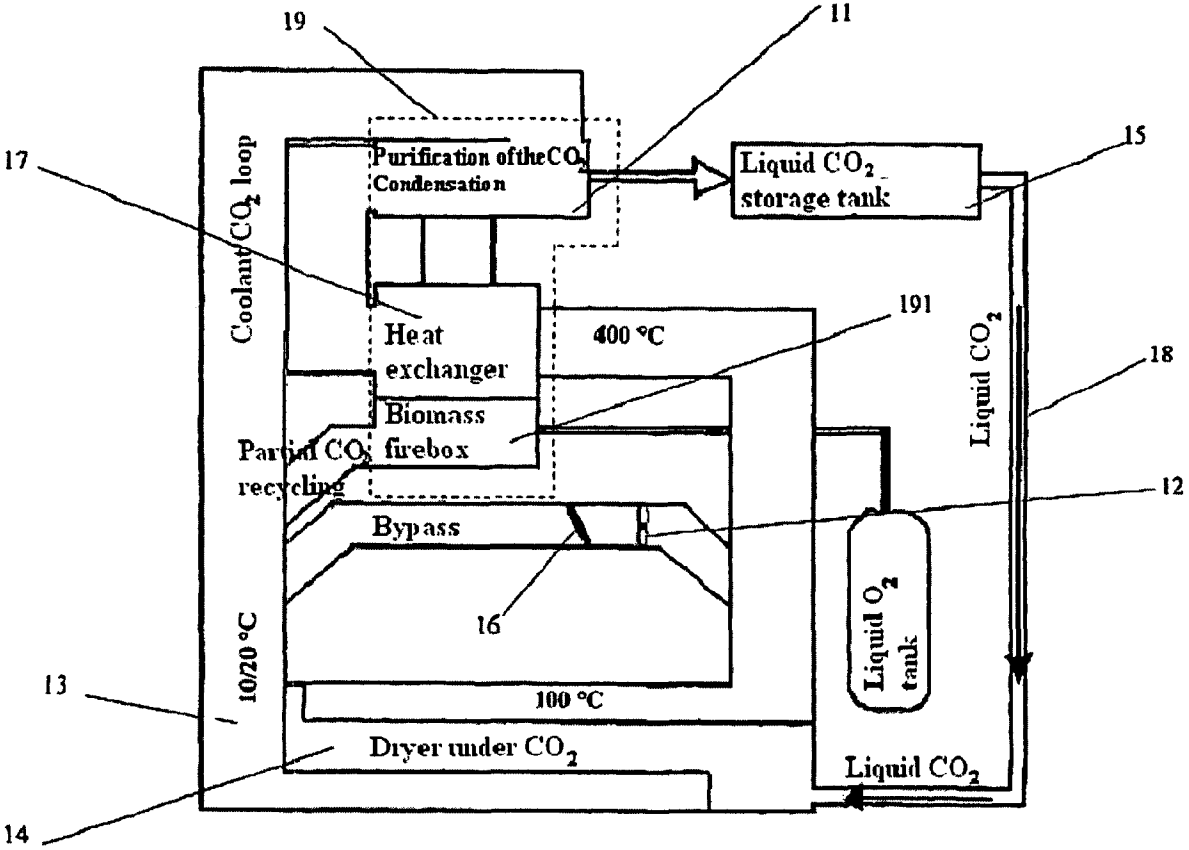
FIG. 1 represents a schematic diagram of a dryer under $CO_2$.

In FIG. 1, the dehydration/condensation heat exchanger 11 is an extraction control space 13 in which the gas extracted from the treatment zone 14 ($CO_2$, plus the steam extracted from the wood) passes through a mist of liquid $CO_2$. This liquid $CO_2$ is produced, in a specific phase of the cycle "$CO_2$ recycling of the general system" where the gas is at a low temperature and purified. A part of this $CO_2$ is compressed to its condensation pressure (approximately 25 bars/and −55° C.) and stored as liquid in a buffer tank 15, whilst awaiting its use. A pipe 18 of $CO_2$ liquid under pressure is arranged in the technical space of the ceiling, it connects the treatment zones to the buffer tank and serves as a service tube to the safety device.

The liquid $CO_2$ which is injected into the exchanger/condenser 11 is therefore under pressure. It is sprayed into this part of the duct by diffusers 78 in order to produce a homogeneous mist. The quantity of liquid $CO_2$ injected is proportional to the heat exchange necessary for the condensation of the steam extracted from the wood 23.

While passing through this mist, the gaseous mixture ($CO_2$ and steam extracted from the wood) extracted from the treatment zone 14 instantaneously evaporates the liquid $CO_2$, and simultaneously causes:

- The cooling down of this same gaseous mixture. The degree of this temperature reduction is a function of the whole of the cycle "$CO_2$ recycling of the general system". It is preferably programmed at around 10° C.,
- the condensation of the steam extracted from the wood 23, which is recovered by gravity in a collector,
- the dewatering of the coolant treatment $CO_2$, which is recycled and ready for a new cycle.

The $CO_2$ extracted from the treatment zone 14 (dewatered) and the $CO_2$ in the condensation/cooling mist (injected as liquid and evaporated) are combined and extracted towards the collector of "recycling $CO_2$ of the general system" by an electric fan 12. This extractor creates a negative pressure in the technical zone concerned, it promotes the transfer of the treatment gases and the evaporation of the water contained in the wood. This fan/extractor 12 is installed in the flow of low temperature (and dehydrated) $CO_2$ (downstream of the condensation cooling mist). The gas ensures and controls the cooling of the electric motor by capturing the heat energy that it releases, which is thus recycled.

The collector of "$CO_2$ recycling of the general system" conveys only $CO_2$ at a low temperature, dewatered and therefore ready for use. A "by-pass" 16, with a shutter controlled electrically by the system programming, makes it possible if necessary to mix this low-temperature $CO_2$ with hot $CO_2$ originating from the exchanger 17 of the heat generator in order to be introduced into the technical zone of the treatment volume in order to regulate its temperature.

The configuration thus produced creates the technical spaces 47*d*, 47*g* in which all the conduits necessary for the method are arranged.

The condensed water is collected and the pressure is boosted in a tank to be used in the drying process. According to the types and characteristics of the wood, the water may be sprayed into the technical drying zone 14, in order to regulate the drying procedure. The excess water is used depending on the environmental conditions. Mixed with mains water it ensures a balancing of the "pH", it can also be reintroduced into the ecosystem without any other form of processing.

Water injection systems are arranged in each zone 14 in order to regulate the drying stress over the wood (water originating from the pressure-boosted tank). This circuit also serves as a safety means for the treatment volume 21.

Similarly, a pipe coming from the heat generator can distribute low-pressure steam, which can be used as a substitute for "liquid" water in order to regulate the drying stress, over the wood.

The overhead technical space is covered by a thermally insulated roof in order to avoid heat losses. The junctions of the horizontal and vertical insulations are well finished, in order to avoid thermal bridges.

Figure 5:
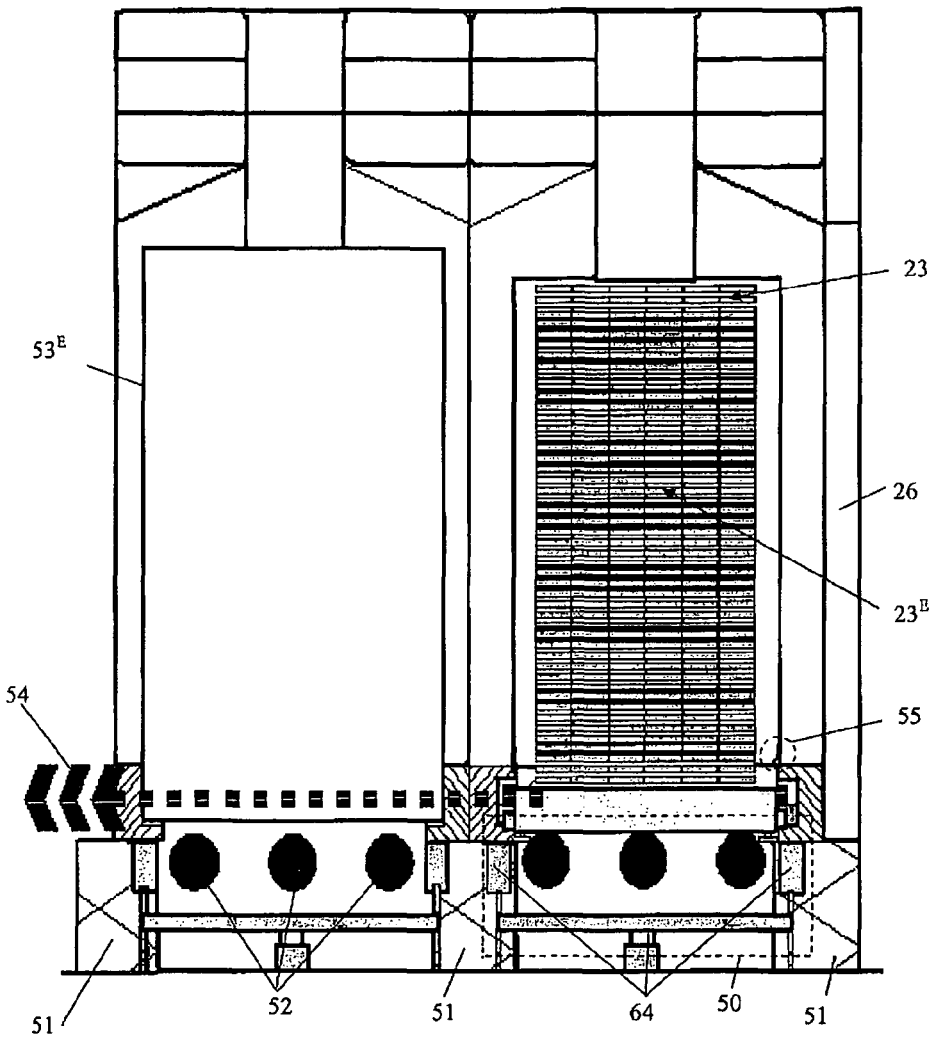
FIG. 5 represents an example with two drying bays one viewed closed, one viewed open from an inlet hatch. A carriage with its load is in the hatch, positioned on the lateral movement mechanism and ready to be introduced into the open bay/tunnel. The last carriage in the line present in the bay/tunnel is visible by a colour difference.
Figure 6:
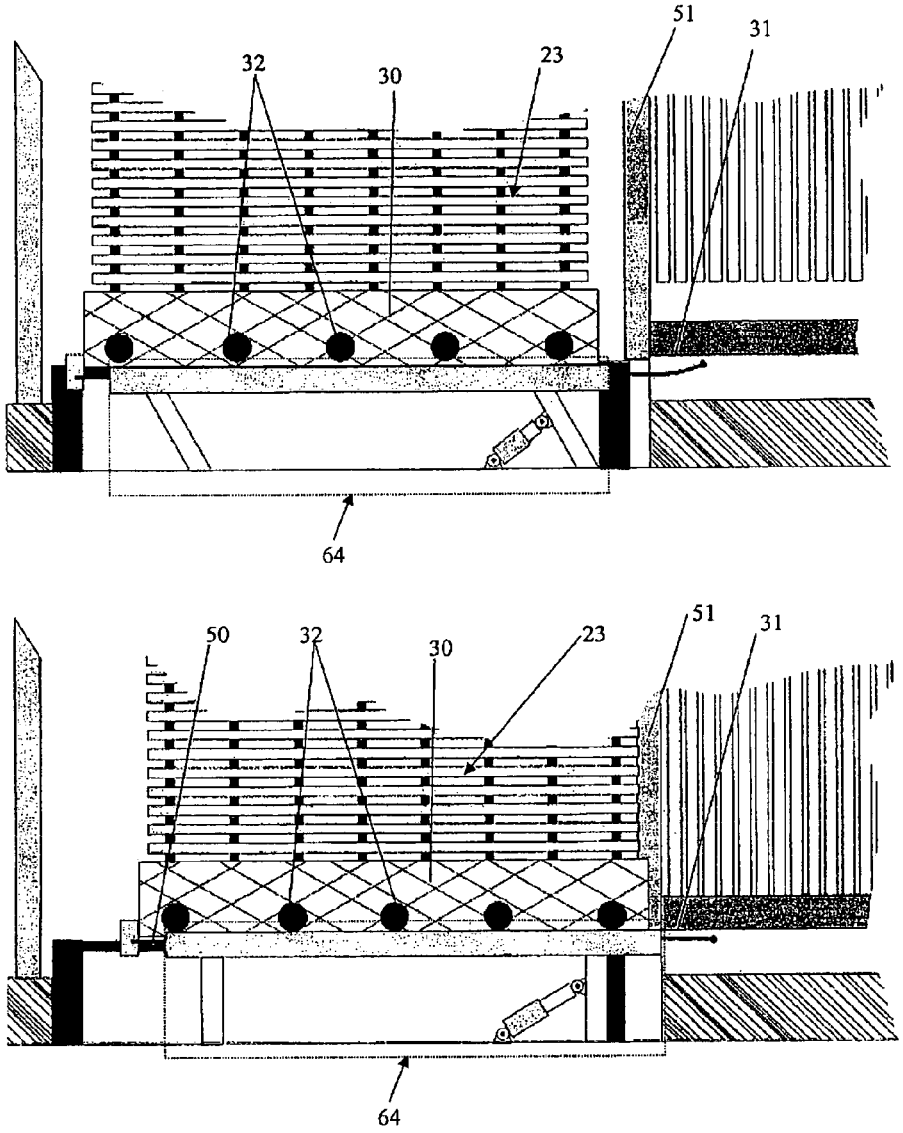
FIG. 6 shows an example of the introduction of a carriage into a bay/tunnel.

The drying unit 20 is installed on a masonry structure, as represented in FIG. 5, which can be of any kind provided that it corresponds to the local standards for installation of this type of activity. This is preferably a clean crawl space (the watertightness of which is proportioned according to the regulation referred to above). The low walls 51, of this clean space, are the masonry bases of each of the vertical partitions 41 of the drying unit 20, the height of these low walls 51 defining the space for maintenance of the systems for traction of the carriages 30, in the hatches 24 and 25 and the central treatment volume 21. This base can be produced by any other system or means, so long as it retains the necessary space under the drying unit 20, in compliance with the standards and the technique (it must be airtight so as not to interfere with the treatment cycle).

The carriages 30 carrying the loads of wood 23 are mobile in their bay/tunnel 22. A lateral hauling system 32 is inserted into the housings 31 (guide rails) provided for this purpose at the bottom of the side partitions 46*g* and 46*d* which form the drying tunnel 22. The dimensions of this carriage 30 are therefore: the width corresponding to the bays 22 and the length corresponding to the load of wood to be treated 23, i.e. for example, 1.45 m in width by 6.50 m in length.

The platform 33 of the carriage 30 comprises a bearing structure, a metal frame the upper face of which is constituted by a solid metal sheet which forms the base on which the load of wood 23 to be treated is laid. Metal crosspieces (spacers) are fixed onto this base in order to maintain the gap necessary for the passage of gas between this metal base sheet and the load of wood 23. A solid metal sheet closes the bottom of the carriage 30, the space thus formed has the thickness of the bearing structure. This space is filled up with insulating material in order to avoid heat losses towards the base. The upper surface of the "platform" carriage 33 is formed such that slopes converge towards the centre of the platform. Orifices communicate with a tank situated within the thickness of the carriage 30. The objective of this system is to collect any condensates originating from the load of wood 23. This tank is systematically emptied at the end of each drying cycle.

Each carriage 30 is equipped with temperature and moisture probes which allow the continuous monitoring of the load of wood 23 during the drying cycle. These probes are connected to boxes situated within the thickness of the carriage 30, a space in which the wiring and the connection boxes allowing the equipment of the load of wood 23 with monitoring p robes are also housed. In this space, retractable mechanisms for allowing the carriage 30 to be secured to the traction and translational movement means can also be arranged. Retractable systems can also be arranged at the ends of the carriages 30 in order to join them in line. These can be electromagnets or any other known system which can be automated.

The hauling system 32 is situated outside the carriage 30, on either side of the side panels, in order to be inserted in the guide rails 31 at the bottom of the of side/vertical partitions 46*g* and 46*d* which form the bay/tunnel 22. This configuration means that the carriages 30 are perfectly adjusted to the width of the bays/tunnels 22. This hauling system 32 can be retractable in order to avoid projections when the carriage 30 is not in the guide rails. The hauling system can equally be sets of bearings installed on the carriages 30 or in the rails/guides of the vertical walls 46*g* and 46*d*. No system of mechanization is necessary in the "treatment volume" space 21. The line of carriages 30 is pushed by the means of introduction of the new load to be treated. The line can also be towed by the carriage 30 leaving said treatment volume 21.

A deflector 55 can be advantageously arranged on the vertical partition, above the rail/guide 31, in order to produce a seal between the platform of the carriage and the vertical wall in order to allow any flows of liquid towards the tank in the carriage 30. This deflector system 55 can be retractable in order to avoid projections when the carriage 30 is not in the guide rails 31, it can be a flexible metal sheet fixed onto the vertical wall which ensures tightness by gravity on the platform 33 of the carriage 30. This tightness guarantees against any penetration of air through the base.

The carriages 30 are one behind the other in the bay/tunnel 22, the carriage 30 originating from the inlet/supply hatch replaces that (front carriage) leaving through the outlet hatch 25 (when the objective of the drying is attained). Between the inlet 24 and outlet hatch 25, the carriages 30 will move, stage by stage, by one carriage length (6.50 m)

A sensor detects the position of the front carriage, the line is stopped when it is in the immobilization position against the exit door $\mathbf{53}^{s}$. It is the exit of the front carriage which allows the line to move forward one carriage length. These stages position the loads 23 in each treatment zone, the stopping duration is programmed as a function of the parameters and the objectives. For example the load of wood 23 which enters with 50% relative moisture "RH" per kg of original material must leave with 12% HR: in our example shown diagrammatically in FIG. 2, the bay 22 contains 6 carriages, each stop corresponds to obtaining the evaporation of $1/6^{th}$ of the moisture to be extracted.

In the bay 22, the technical treatment zones follow one another without separation. A thermodynamic and aeraulic study has demonstrated that the interaction of one zone with that which precedes it and that which follows it, is a few centimeters, without affecting the programming and the final result. Each zone is managed by the general cycle programming, they are however autonomous and can be controlled separately (if one of the program settings is not reached or is exceeded, the operators can intervene and optimize the controls, in the same way that the computer program can interact) Each connection box, installed on the carriages 30, receives a retractable connector (in the wall, at each "technical treatment zone" stage) which connects the carriage 30 to the computer program. The system for connection and positioning of each carriage 30 can also be infrared or radio-controlled, this choice being defined by the end user.

A connection from each zone 22 links the carriages 30 to the "technical treatment zone" corresponding to their respective position. The probes transmit the data from the load of wood 23 to the computer program which manages said zone. The cycle is continued until the objective is achieved. Each zone is parameterized as regards temperature and volume of treatment $CO_2$ in order to evacuate the quantity of water contained in the wood 23 (programmed zone by zone, in the example 6.4% of the total).

The basic heat calculations determine these settings in the pre-established program. If during the specified immobilization time, the program detects an anomaly (or the objective is not achieved) the zone management can intervene in order to modify the temperature and the volume of $CO_2$ introduced (the "immobilization time" data must be as regular as possible for the good management of the treatment, it can nevertheless be modified during the cycle). The zone management increases these parameters in the case of insufficiency, or reduces them if drying is too rapid, or allows the injection of water, or of steam in order to regulate the drying, or stops the injection of $CO_2$ if the zone objective is achieved before the specified time.

When the front-end cycle is finished (last "technical treatment zone") the load 23 of the front carriage 30 has reached the required degree of moisture. The front carriage 30 can then be transferred into the outlet hatch 25.

The outlet hatch 25 is configured such that the dimension which is in the extension of the bays/tunnels 22 (width of the hatch) allows the lateral movement of a carriage 30. If it is for example 6.50 m, plus the clearance requirements for opening the doors 53 of the bays/tunnel 22 (if the doors $\mathbf{53}^{S}$ of the treatment volume 21 clear by their thickness in the hatch and slide to the right or to the left in order to provide free access to the bay 22 concerned) and the operating margins for correct use.

The doors $\mathbf{53}^{E}$ and $\mathbf{53}^{S}$ blocking the bays/tunnels 22 can be rolling slat blinds as well as full doors actuated by any opening system, the choice being determined only by the thermal benefit and the operating rationale. Each hatch 24, 25 has as its length the width of the treatment volume 21 (which relates to the number of bays/tunnels 22, in the example described in FIG. 2 there are four).

The (outlet) hatch 25 opens to the outside by a sliding door 26, parallel to the direction of the carriages 22 in the hatch 25 (in the longitudinal direction of the drying unit 20) in order to allow the extraction of the carriages 30 carrying the dried wood. The removal of the carriage 30 can also be carried out in the direction of progression of the bays 22 (in the longitudinal direction of the drying unit 20) if required by the configuration and the arrangement of the work space. In this case, the door or doors slide perpendicularly to the direction of progression of the carriages 30. One or other of these functions is defined by the end user during design of the unit, the two functions being able to be applied to a same unit 20. The doors 26 opening to the outside must be insulated in order to limit heat losses, which means that they are made of a single piece. If the treatment/drying volume is well insulated, these doors opening to the outside can be any other types of known opening.

The hatch 25 comprises a mechanism 50 with rollers 52, or any other known means, which allows the lateral movement of the carriages 30: from the location corresponding to its exit from a bay/tunnel 22, as far as the outer door 26 through which it is removed. The carriage 30 can be pulled or pushed by any known system.

When a bay/tunnel 22 is opened for the removal of a dried load 23, the doors 26 opening the outlet hatch 25 to the outside are closed (the system's safety device controls this function) and the hatch 25 is under $CO_2$. A sensor monitors this filling operation by analyzing the decompression gas: the introduction of the $CO_2$ into the hatch 25 drives out the air which enters during the final exit of a carriage 30.

In order that the $CO_2$ which is contained in the hatch 25, or that which escapes from the bay/tunnel 22 upon the opening of the communication door, is not dispersed to the outside, the communication door(s) 26 of the hatch 25 to the outside is (are) kept permanently closed. They are opened only in order to remove one (or more) carriages 30 ready to be used, this function is possible only when the doors 53 blocking the ends of the bays/tunnels 22 are kept closed.

The carriages 30 which are introduced into the outlet hatch 25 (coming from the treatment volume 21) having completed the programmed drying cycle, are retained in the hatch until the temperature of the wood is reduced. For this purpose, a continuous circulation of cold $CO_2$ is established in the hatch 25. This $CO_2$ comes from the so-called collector for "recycling $CO_2$ from the general system". Having circulated in the outlet hatch 25 and served to cool down the wood, it is loaded with the sensible heat from the wood. This heat capacity is thus recycled and contributes to the economy of the method. The $CO_2$ is continuously extracted from the hatch 25 in order to be reintroduced into the coolant $CO_2$ management system of the unit 20. The heat is recycled and the wood is cooled down, it does not undergo heat shock on leaving the hatch 25. The carriages 30 are removed from the outlet hatch 25 as required by the industrial site where the drying unit is installed, or in order to be loaded onto transport lorries.

In order to be able to remove carriages 30, the outlet hatches 53$^S$ of the bays/tunnels 22 must be closed and the $CO_2$ evacuated from the hatch 25 (the conditions are the same as for the inlet/supply hatch 24).

If the load of wood 23 which is introduced into the outlet hatch 25 is dedicated to an automated conversion system, with no need for any human presence, the carriage 30 can be removed without the $CO_2$ being evacuated from the hatch 25. For example, if a load 23 is dedicated to a heat treatment system of the wood at a high temperature, and if the high-temperature treatment system is joined side by side (and communicating) with the outlet hatch 25, the carriage 30 can be transferred into the enclosure of this system without waiting for the load to cool down.

When the systems monitoring these parameters allow it, the communication door 53$^S$ of the bay/tunnel 22 concerned with the outlet hatch 25 can be opened. The zone connections are disconnected in each technical zone concerned, the line of carriages regains its mobility.

The front carriage can be removed from the bay/tunnel 22 and transferred into the outlet hatch 25:

- the communication door 53$^S$, of the bay/tunnel 22 concerned with the outlet hatch 25, is opened;
- when the door 53$^S$ is open, two retractable rails 64 are positioned at the level of the guide rails 31 of the walls of the bay/tunnel 22 concerned, so as to ensure the movement of the front carriage 30 into the outlet hatch 25, without it being interfered with by the lateral movement system;
- the front carriage 30 is removed from the bay/tunnel 22 concerned by a chain system, or similar, which is positioned automatically once the communication door 53$^S$ is open. It is retracted once the door 53$^S$ is closed. If the mechanism for removal of the front carriage 30 does not take up the line of carriages 30 from the bay/tunnel 22, the others remain in their place. If the choice is made to set the line of carriages 30 in motion using the mechanism for removal of the front carriage 30, the whole line is pulled until a system detects that the new front carriage 30 is at its destination (terminal zone) The carriage 30 to be removed is then disconnected from the line and its removal finalized.

Once the front carriage removal cycle is completed, when the (so-called front) load 23 is in the outlet hatch 25:

- the two retractable rails 64, on which the carriage 30 was positioned at the height of the rails/guide rails 31 of the wall of the bay/tunnel concerned are lowered and retracted. The carriage 30 is then positioned on the lateral displacement mechanism 50 of the hatch 25. In the inlet 24 and outlet hatch 25 the carriages 30 are laterally displaced;
- the communication door 53$^S$, of the bay/tunnel 22 concerned with the outlet hatch 25, is closed again;
- the communication door 53$^E$, of the bay/tunnel 22 concerned with the inlet/supply hatch 24 is opened. This door can open only if the communication door(s) 27 of the (inlet/supply) hatch 24 to the outside is closed;
- when the door 53$^E$ is open, two retractable rails 64 are positioned under the lateral rolling mechanisms of the corresponding carriage 30, being situated in the inlet/supply hatch 24;
- as shown in FIGS. 5 then 6, the carriage 30, carrying the new load of wood to be treated 23$^E$, is slightly raised by the two retractable rails 64 which are positioned under the lateral rolling mechanisms of the carriage, in order to be released from the lateral movement mechanism 50 of the hatch 24, and be positioned at the level of the guide rails 31 of the walls of the bay/tunnel 22 concerned). A new load of wood 23$^E$ present in the inlet hatch 24 in order to be introduced into a bay 22 and a load of wood 23 introduced previously are shown in FIG. 5. The arrow 54 indicates a direction of movement of the loads of wood in the inlet hatch. 24 and/or in the outlet hatch 25;
- The carriage 30, carrying the new load of wood to be treated, can be introduced. The carriage 30 is then transferred by a known system of introduction (chain, conveyor worm, pulled or pushed carriage etc.) which is positioned automatically once the communication door 53E to the bay/tunnel 22 is open. It is retracted once the door is closed;
- The carriage 30, carrying the new load of wood to be treated, is introduced into the bay/tunnel until it is in contact with the rear carriage in the line.

The line is then rolled up to the communication door 53$^S$ to the outlet hatch 25 (which is closed) pushed by the new carriage and its introduction system.

When the new front carriage in the line is in contact with the outlet door 53$^S$ (of the ebay/tunnel) a sensor detects the position, the line is completed.

If it is the mechanism for removal of the completed load which is pulling the line, the introduction of the new load is detected as "finalized" when the new carriage is in contact with the line and secured to it. The line is complete and the following method is implemented:

- the introduction system is released and returns to its starting position, the positioning rails 64 of the carriage 30, in the inlet/supply hatch 24, are released at rest, the inlet door $53^E$ of the bay/tunnel 22 closes again. If the inlet $53^E$ and outlet $53^E$ doors of the treatment volume have lateral opening, they are thermally insulated. The door is released from the frame to be closed and slides in front of the door of the neighbouring bay 22. There can only be one door open at a time over a volume comprising two or three parallel bays 22, except in respect of the clearances and the bearing structures accordingly. The inlet $53^E$ and outlet $53^S$ doors of the treatment volume can be of the "rolling slat blind" type provided that the heat insulation of the hatches 24 and 25 and their door leaves are well insulated.

The line is once again complete and the cycle continues until the treatment of the front load is completed. During the operations of removal of the dried load 23 and of that which is takes its place, the system can be configured so that the treatment cycle of the other carriages 30 of the bay 22 concerned is not interrupted. For this purpose the airtightness of the base of the drying unit 20 must be perfect, particularly if it is the line of carriages 30 which is the base of the treatment zone 21. A more effective tightness can be produced between the carriages and the walls and between the carriages themselves by any known method.

A new load 23 can be introduced into the inlet/supply hatch 24 by replacing that introduced into the treatment volume 21. For this purpose the $CO_2$ contained in the hatch 24 is evacuated by electrical extraction and reintroduced into the $CO_2$ cycle of the drying unit 20. It is then possible to open the outer door 27 of the inlet hatch 24 in order to provide a new carriage 30 in this hatch 24, in the place of the preceding one.

The inlet/supply hatch 24 is configured such that the dimension which is in the extension of the bays/tunnel 22 allows the lateral displacement of a carriage 30. If it is for example 6.50 m, the greater the plus the clearance requirements for opening the doors of the bays/tunnel 22 (if the doors $53^S$ of the treatment volume 21 clear by their thickness in the hatch and slide to the right or to the left in order to free access to the bay 22 concerned) and the operating margins for correct use. Each hatch 24 and 25 has as its length the width of the treatment volume 21 (which relates to the number of bays/tunnels 22, in the example described here there are four).

The inlet/supply hatch 24 opens to the outside by a sliding door 27, parallel to the direction of the carriages 30 in the hatch 24 (in the longitudinal direction of the drying unit 20) in order to allow the introduction of the carriages 30 loaded with wood to be dried 23. The introduction of the new load can also be carried out in the direction of progression of the bays 22 (in the longitudinal direction of the drying unit 20) if required by the configuration and the arrangement of the work space, in this case the door or doors slide perpendicularly to the direction of progression of the carriages. One or other of these functions are defined by the end user during design of the unit. The two functions can be applied to the same unit 20.

As shown in FIG. 5, the hatch 24 comprises a mechanism 50 with rollers 52, or any other known means, which allows the lateral movement of the carriages 30 up to the location corresponding to its introduction into a bay/tunnel 22 The carriage 30 is pulled or pushed by any known system. The hatch 24 can contain as many carriages 30 carrying loads ready for drying as the treatment volume 21 comprises bays/tunnels 22. Upon the introduction of a carriage 30 into the hatch 24, the lateral rolling systems 32 which allow it to be engaged in the rails/guides 31 of the walls 46*d*, 46*g* of the bays/tunnels 22, are released (if they are retractable).

When a bay/tunnel 22 is opened for the introduction of a new load $23^E$, the doors 27 opening the inlet hatch 24 to the outside are closed (the system's safety device controls this function) and the hatch is under $CO_2$. A sensor monitors this filling operation by analyzing the decompression gas (the introduction of the $CO_2$ into the hatch drives out the air which enters during the loading of the carriage).

The inlet and outlet hatches 24 and 25 can be identical. The carriages 30 removed from the outlet hatch 25, once freed from their load of dried wood 23, can be reloaded with wood to be treated, in order to be introduced into the inlet/supply hatch 24.

The movement of the empty carriage 30 between the outlet hatch 25 and the loading station (of wood to be dried) can be automated.

The movement of the loaded carriage between the loading station and the inlet/supply hatch 24, as well as its introduction into the hatch 24 can be automated.

The heat generator 19 is designed in particular for:

producing the heat necessary for the corrected operation of the unit, producing the $CO_2$ used by the method, and regenerating and purifying the flow of treatment $CO_2$.

For this purpose the heat generator 19 is a system of combustion of solid fuel under $O_2$, preferably free of pollutants. This solid fuel is unpolluted vegetable biomass, preferably densified [Bio-D]®, or pieces of torrefied wood, or any other form of vegetable biomass suitable for the method.

The configuration of the firebox 191 of the heat generator 19 is designed in order to allow the introduction of small pieces of waste wood (sawdust and even fine waste from sanding etc.) so that the combustion of these waste products is absolute (no loss of combustible material unburnt in the combustion gas).

The combustion under $O_2$, of vegetable fuel, free from pollutants, produces only $CO_2$. The generator is equipped with a heat exchanger 17 at the outlet of which the $CO_2$ is recovered in order to be used in the drying method and its peripherals.

The heat of the combustion gas ($CO_2$) is transferred to the operating $CO_2$ (coolant) in the exchanger.

The $CO_2$ originating from the combustion is cooled down to the maximum in the heat exchanger 17 by the operating means:

transfer of the heat to the coolant gas of the drying method and cooling by transfer of the latent heat of gasification to the liquid oxygen, which must be in gaseous phase for the combustion of the biomass in the generator.

Part of the $CO_2$ originating from the combustion, once cooled down, is sucked in by a compressor (known industrial means) in order to be taken to its condensation pressure 15. The latent heat of condensation of the $CO_2$, and that produced by the electric motor of the compressor, are transferred to the operating $CO_2$ (coolant). All of these systems and means are known and familiar to the industry.

The liquid $CO_2$ is stored in a buffer tank 15, before its use in the system.

The part of $CO_2$, originating from the combustion, which is not liquefied is at a low temperature, and is exploited as it is by the method in order to be the coolant flow for all the heat transfers of the operating systems and of the wood drying method.

All of the $CO_2$ is recovered on leaving the generator 19, both that generated by the combustion and that used in the method and recycled by the generator 19. There is no gaseous discharge at the outlet from this system and therefore no chimney.

The $CO_2$ liquid is used in particular for:

The dehydration of the coolant flow for treatment of the wood,

The safety of the treatment unit 20 (fire safety neutralizing the environment and producing carbon dioxide snow), For all the uses of the method requiring a rapid cooling down, For providing mechanical pressure to certain systems of the method, etc.

The coolant $CO_2$ originally comes from the combustion of the vegetable biomass under $O_2$. It is used in a loop in the so-called system for "recycling $CO_2$ of the general system" and it is regularly recycled/regenerated and purified in the heat generator 19. The quantity of coolant $CO_2$ is therefore growing and its volume must be limited to that strictly needed by the method. For this purpose, the excess is liquefied and stored for the use of the unit.

As this use is also limited, the excess liquid $CO_2$ can be marketed and or rendered inert according to known processes.

The coolant $CO_2$ is used in a "semi-closed" circuit during which it passes through all the stages:

The coolant $CO_2$ acquires its heat capacity and its temperature in the heat exchanger 17 of the generator 19 without any contact with the combustion gas from the vegetable biomass.

The coolant $CO_2$ is transferred to the technical treatment volume 14, where it makes it possible to raise the temperature of the wood to be treated and where it transfers its heat capacity to the moisture to be extracted. It thus provides the water with its latent heat of evaporation.

The coolant $CO_2$ and the steam are then extracted from the treatment volume in order to be transferred to the dehydration heat exchanger 11 (condenser) where the water is separated from the coolant $CO_2$.

The dehydration/condensation heat exchanger 11 is a system in which the gaseous mixture extracted from the treatment volume (the coolant $CO_2$ and the steam) passes through a mist of liquid $CO_2$, under pressure, atomized, (the liquid $CO_2$ is at a negative temperature of "minus"−55° C.).

The liquid $CO_2$ diffusion manifolds 78 are situated in the hot flow originating from the treatment volume, in order to avoid parasitic water glaciation phenomena. The liquid $CO_2$ is sprayed and atomized in the direction of the gaseous flow to be dried. Passing through this spray, the coolant $CO_2$ is cooled down and the steam condensed. The latent heat of condensation of the steam is transferred to the liquid $CO_2$, which draws its latent heat of evaporation from it. The enthalpy of the two phenomena being different, compensation is carried out by the volumes of one relative to the other.

The condensed water is recovered by gravity. It is free of any pollutant, it contains only a few "percent" of solubilized $CO_2$ which enrich it before its reintroduction into the ecosystem. This recovered water is used first in the industrial treatment unit.

The coolant $CO_2$ is then dewatered, it is mixed with that which was introduced in liquid phase and vaporized. The temperature of the two volumes of gaseous $CO_2$, at the outlet from the dehydration/condensation heat exchanger 11, is low (temperature less than or equal to 10° C.) This $CO_2$ is transferred to the so-called "general system $CO_2$ recycling" cycle where it will be regenerated for the use in the method. Part of this $CO_2$ is extracted in order to be compressed/liquefied.

The residual gaseous volume will transit through the peripherals to be cooled down (the extraction fans, the compressor and the outlet hatch etc.) in order to capture their heat. This coolant $CO_2$ is then transferred to the heat exchanger of the generator where it acquires its treatment heat capacity, the loop is completed and the cycle continues. Part of this $CO_2$ is removed from the cycle in order to be regenerated/purified by the heat generator, in the firebox for combustion of the vegetable biomass under $O_2$.

The drying method according to the invention is not limited to the example described above and can be applied to other fields.

The invention claimed is:

1. A thermal method for drying a load of wood, the method comprising:

generating heat from heat generating means;

generating a gaseous coolant flow for treating the load of wood by combustion of biomass under $O_2$, said gaseous coolant flow essentially comprising $CO_2$;

transferring the heat produced by the heat generating means, to said gaseous coolant flow for treating the load of wood; and drying the load of wood wherein the drying step comprises:

introducing said load of wood into a treatment volume, drying said load of wood in said treatment volume wherein the load of wood is in contact with the gaseous coolant flow, removing said dried load of wood from the treatment volume, and recovering or recycling of the gaseous coolant flow after treatment of the load of wood, wherein the recovering or recycling step comprises the step of passing the gaseous coolant flow through a mist of liquid $CO_2$ under pressure and atomized in order to condense a steam extracted from the wood by the gaseous coolant flow to obtain a recycled gaseous coolant flow appropriate for treating the load of wood.

2. The method according to claim 1, wherein the recycled gaseous coolant flow has a temperature less than or equal to 10° C.

3. The method according to claim 2, wherein part of the recycled gaseous coolant flow is extracted to be liquefied.

* * * * *